US011059704B2

(12) United States Patent
Yamamoto

(10) Patent No.: US 11,059,704 B2
(45) Date of Patent: Jul. 13, 2021

(54) COUNTERWEIGHT DEVICE AND CONSTRUCTION MACHINE

(71) Applicant: SUMITOMO HEAVY INDUSTRIES CONSTRUCTION CRANES CO., LTD., Tokyo (JP)

(72) Inventor: Kazunori Yamamoto, Aichi (JP)

(73) Assignee: SUMITOMO HEAVY INDUSTRIES CONSTRUCTION CRANES CO., LTD., Tokyo (JP)

( * ) Notice: Subject to any disclaimer, the term of this patent is extended or adjusted under 35 U.S.C. 154(b) by 0 days.

(21) Appl. No.: 15/897,899

(22) Filed: Feb. 15, 2018

(65) Prior Publication Data

US 2018/0229981 A1 Aug. 16, 2018

(30) Foreign Application Priority Data

Feb. 16, 2017 (JP) ..... JP2017-027170

(51) Int. Cl.
*B66C 23/74* (2006.01)
*B66C 23/00* (2006.01)

(52) U.S. Cl.
CPC ..... *B66C 23/74* (2013.01); *B66C 23/54* (2013.01)

(58) Field of Classification Search
CPC ..... B66C 23/54; B66C 23/72; B62D 49/085; B66F 9/07554
See application file for complete search history.

(56) References Cited

U.S. PATENT DOCUMENTS 3,375,021 A * 3/1968 Grider ..... B66C 23/74 280/759
4,402,413 A * 9/1983 Sickler ..... E02F 9/18 212/178
5,598,935 A * 2/1997 Harrison ..... B62D 49/085 180/69.1
7,354,066 B2 * 4/2008 Yamamoto ..... B62D 49/085 280/759
7,658,293 B2 * 2/2010 Yamamoto ..... B66C 23/74 212/178

FOREIGN PATENT DOCUMENTS

JP 2006-044948 A 2/2006
JP 2007-091404 A 4/2007

* cited by examiner

*Primary Examiner* — Sang K Kim
*Assistant Examiner* — Nathaniel L Adams
(74) *Attorney, Agent, or Firm* — Michael Best & Friedrich LLP

(57) ABSTRACT

A counterweight device including a base plate having a mounted counterweight, a hydraulic cylinder that raises/lowers the counterweight mounted on the base plate, a detachable frame connecting the base plate and a cylinder rod of the hydraulic cylinder, a first pin pivotably supporting the detachable frame with respect to the cylinder rod, a guide coupling portion guiding a free end side of the detachable frame to the rear end portion side of a turning frame in response to a stretching/shrinking state of the cylinder rod, and coupled to the turning frame below an upper end of the rear end portion, and a rail (guide member) guiding the free end side of the detachable frame in a direction parallel to a stretching/shrinking direction of the cylinder rod. The mounting table and the hydraulic cylinder may be supported by a rear end portion of a machine body frame of a construction machine.

20 Claims, 11 Drawing Sheets

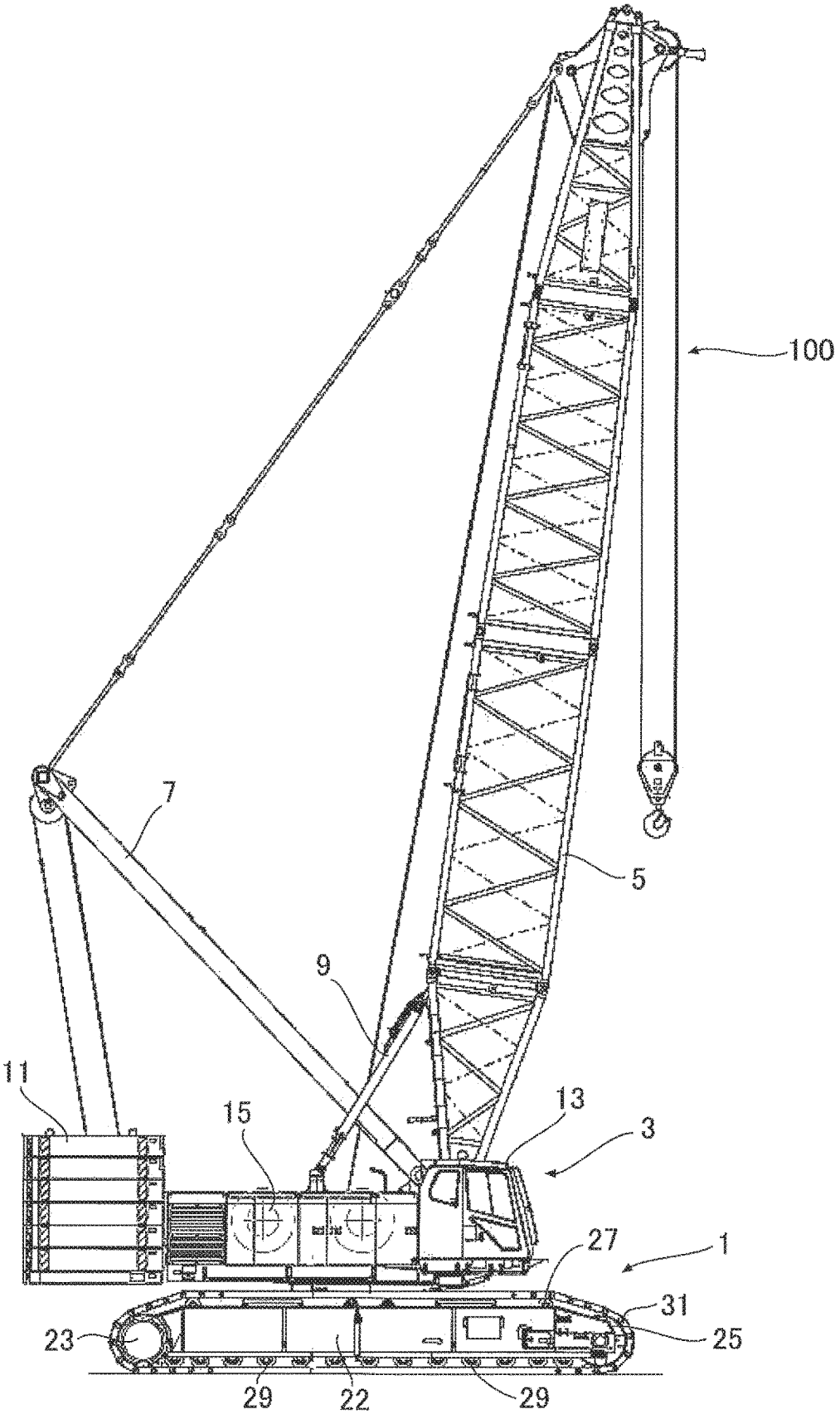
100
7
5
9
11
15
13
3
27
1
31
23
25
29
22
29

FIG. 2B
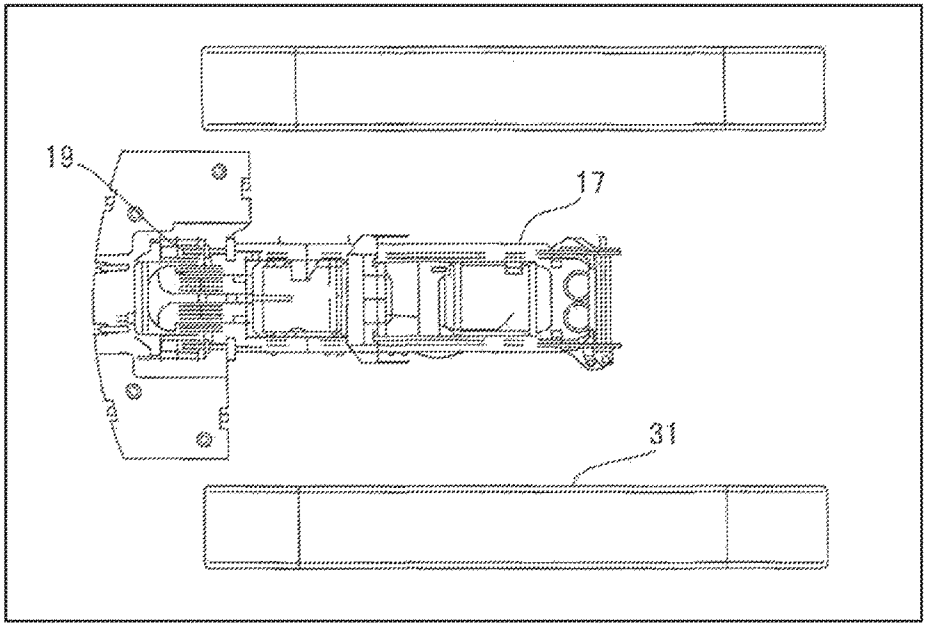
FIG. 2A
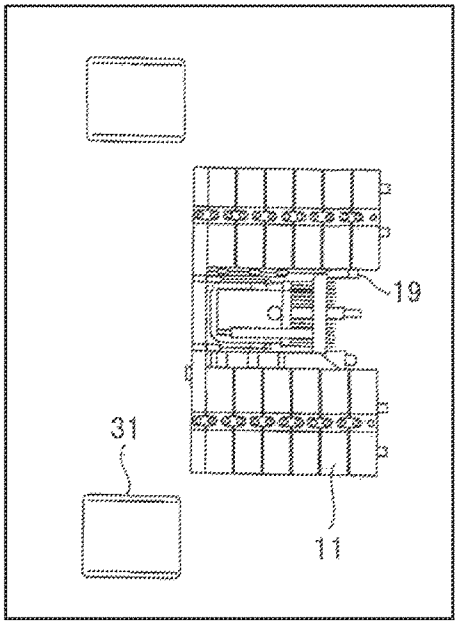
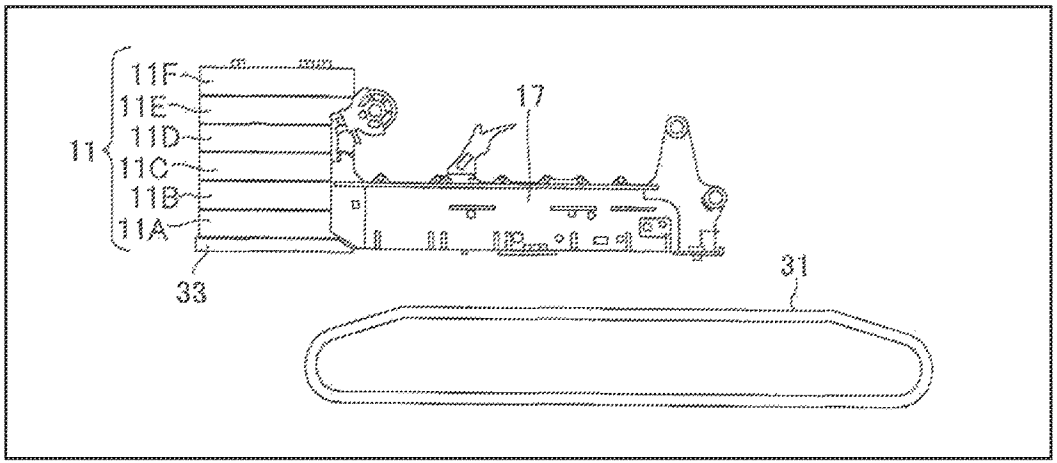
FIG. 2C

COUNTERWEIGHT DEVICE AND CONSTRUCTION MACHINE

RELATED APPLICATIONS

This application claims the Convention priority based on Japanese Patent Application No. 2017-027170 filed on Feb. 16, 2017, the content of which, including the specification, the claims and the drawings, are incorporated herein by reference in their entirety.

BACKGROUND

Technical Field

Certain embodiments of the present invention relate to a counterweight device and a construction machine including the counterweight device.

Description of Related Art

In a construction machine such as a crawler crane, a counterweight is attached to a rear end portion of a machine body frame in order to ensure stability of the machine body when work is carried out. Since the counterweight is heavy, the counterweight is detached from a machine body frame in order to reduce a transport weight when the construction machine is transported. The counterweight is attached to and detached from the machine body frame by using a counterweight device. As the construction machine including the counterweight device, the related art discloses the following known technologies, for example.

In the known technologies, the related art discloses one configuration as follows. A counterweight attachment/detachment unit for attaching the counterweight to a turning frame includes a second frame detachably attached to a first frame and forming the turning frame together with the first frame, and a hydraulic actuator moving so that the counterweigh can be attached to the second frame in a state where the second frame is attached to the first frame. The hydraulic actuator pushes up the second frame so as to be attachable to the first frame, and raises the counterweight so as to be attachable to the second frame after the second frame is attached to the first frame. The hydraulic actuator is configured to function as a hydraulic cylinder.

In the known technologies, the related art discloses another configuration of a counterweight device of a construction machine in which a counterweight is attached to a machine body frame of the construction machine. The counterweight device includes a first engagement groove disposed in a counterweight, a second engagement groove disposed in the machine body frame, a first engagement member projecting in the counterweight and engaging with the second engagement groove when the counterweight is attached, a second engagement member projecting in the machine body frame and engaging with the first engagement groove when the counterweight is attached, and fixing means for fixing the counterweight to the machine body frame in a state where the first engagement member engages with the second engagement groove and the second engagement member engages with the first engagement groove.

SUMMARY

According to an aspect of the present invention, there is provided a counterweight device including a mounting table on which a counterweight is mounted, a hydraulic cylinder that raises and lowers the mounting table, a connection structure that connects the mounting table and a cylinder rod of the hydraulic cylinder, a pivoting spindle that pivotably supports the connection structure with respect to the cylinder rod, a guide coupling portion that guides a free end side of the connection structure to the rear end portion side of the machine body frame in response to a stretching/shrinking state of the cylinder rod, and that is coupled to the connection structure below an upper end of the rear end portion, and a guide member that guides the free end side of the connection structure on the hydraulic cylinder side in a direction parallel to a stretching/shrinking direction of the cylinder rod. The mounting table and the hydraulic cylinder may be supported, for example, by a rear end portion of a machine body frame of a construction machine.

BRIEF DESCRIPTION OF THE DRAWINGS

FIG. 1 is a side view illustrating an overall configuration of a crawler crane serving as a construction machine according to an embodiment of the present invention.

FIGS. 2A to 2C are three orthographic views illustrating a lower traveling body, a turning frame, a counterweight attachment/detachment device, and a counterweight of the crawler crane in FIG. 1.

DETAILED DESCRIPTION

Figure 3:
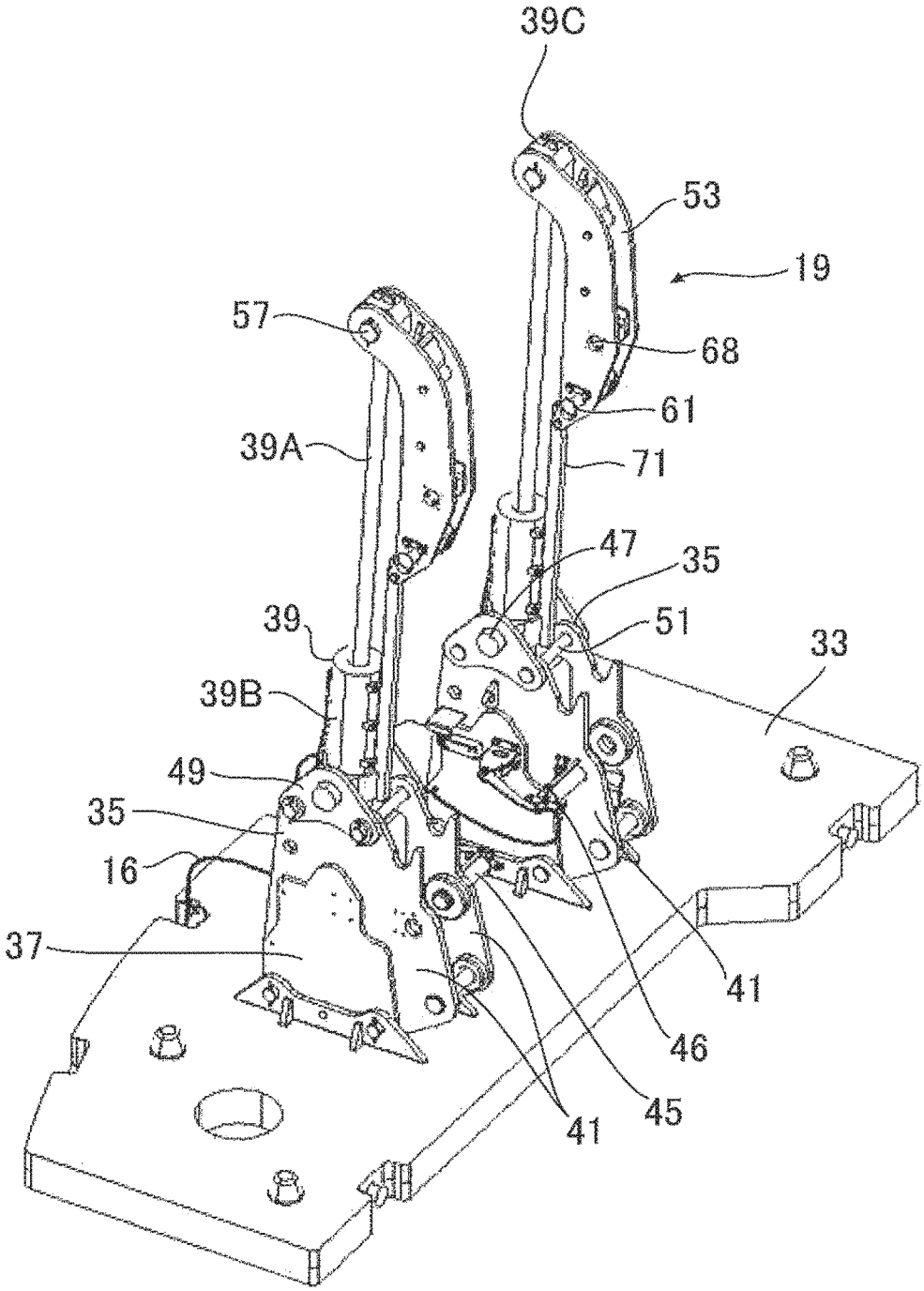
FIG. 3 is a perspective view illustrating a configuration of the counterweight attachment/detachment device and a base plate of the counterweight in FIGS. 2A to 2C.

Hereinafter, an embodiment according to the present invention will be described with reference to the drawings.

FIG. 1 is a view illustrating an overall configuration of a crawler crane serving as a construction machine according to the embodiment of the present invention. In the drawing, a crawler crane 100 including a counterweight attachment/detachment device serving as a counterweight device is basically configured include a lower traveling body (crawler) 1, an upper turning body 3, a boom 5, a mast 7, a backstop 9, and a counterweight 11. The upper turning body 3 is disposed on the lower traveling body 1 so as to be capable of turning via a turning wheel. The boom 5 is pivotably supported by the upper turning body 3 so as to be capable of derricking. A cab (operator's cab) 13 is installed in an end portion of the upper turning body 3 which is opposite to an installation side of the counterweight 11. A house (machine room) 15 is disposed between the cab 13 and the counterweight 11.

A hoisting drum serving as a hoisting winch drum and a derricking drum serving as a derricking winch drum are mounted on the turning frame 17. A hoisting rope is wound around the hoisting drum, and the hoisting rope is wound or unwound by driving the hoisting drum, and a hook suspended from a distal end of the boom 5 is raised and lowered. A derricking rope is wound around the derricking drum, and a derricking rope is wound around or unwound from the derricking drum by driving the derricking drum. In this manner, the boom 5 performs a derricking operation.

A hoisting hydraulic motor and a derricking hydraulic motor are installed inside the turning frame 17. The hoisting drum is driven by the hoisting hydraulic motor, and the derricking drum is driven by the derricking hydraulic motor. A brake device for braking the hoisting hydraulic motor and the derricking hydraulic motor is installed therein so as to control the driving of the hoisting hydraulic motor and the derricking hydraulic motor.

FIGS. 2A to 2C are three orthographic views illustrating the lower traveling body 1, the turning frame 17, the counterweight attachment/detachment device 19, and the counterweight 11 of the crawler crane 100. FIG. 2A is a plan view, FIG. 2B is a side view when FIG. 2A is viewed from a left side, and FIG. 3C is a front view. In FIGS. 2A to 2C, the turning wheel, the cab 13, the mast 7, and the boom 5 are omitted. The turning frame 17 configures a portion of the upper turning body 3.

The lower traveling body 1 includes a crawler side frame 22, a driving wheel 23, a driven wheel 25, an upper roller 27, a lower roller 29, and a shoe 31. The driving wheel 23 and the driven wheel 25 are disposed in front and rear portions of the crawler side frame 22, and the driving wheel 23 is driven by a traveling device. The lower roller 29 is installed in a lower portion of the crawler side frame 22, and the upper roller 27 is installed in an upper portion of the crawler side frame 22. The shoe 31 is wound around the driving wheel 23, the lower roller 29, the driven wheel 25, and the upper roller 27 so as to configure an endless track. The reference numeral 33 represents a base plate on which the counterweight 11 is mounted.

Figure 4:
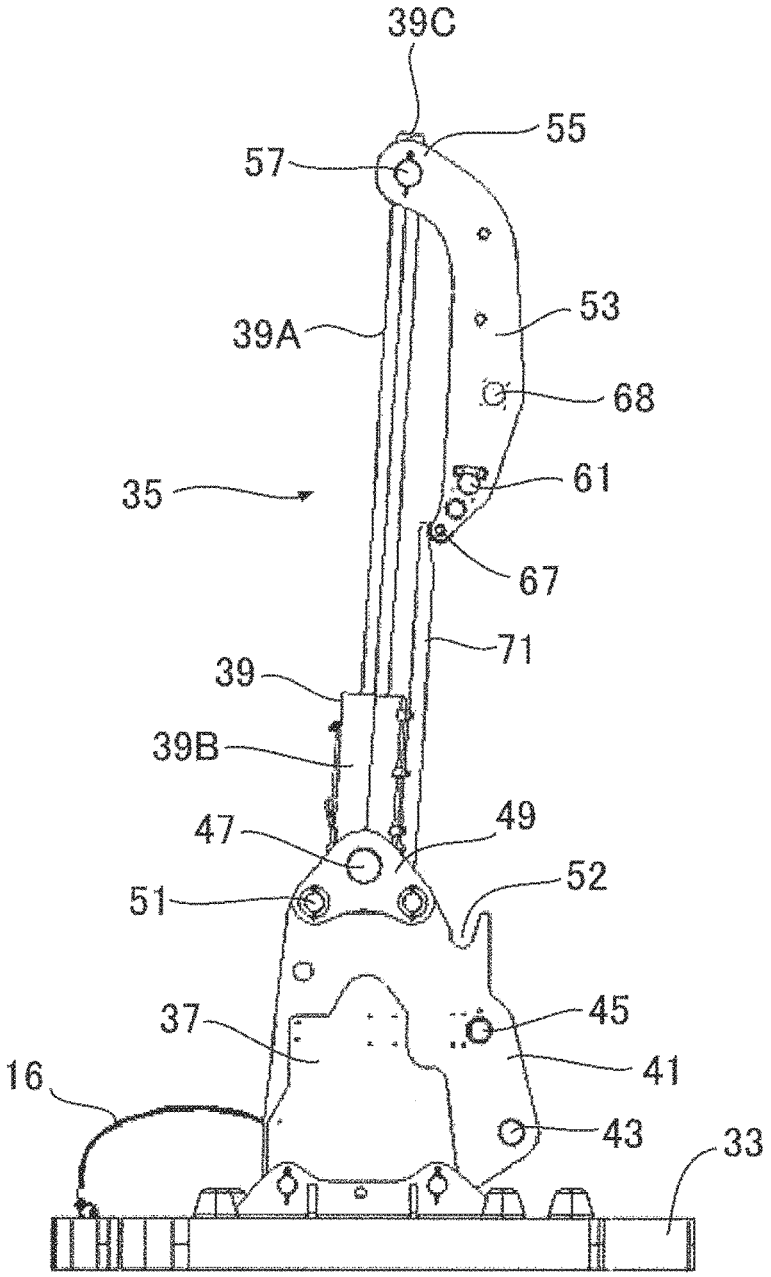
FIG. 4 is a side view of FIG. 3.

FIG. 3 is a perspective view illustrating a configuration of the counterweight attachment/detachment device 19 and the base plate 33 of the counterweight 11. FIG. 4 is a side view of FIG. 3.

In FIG. 3, the counterweight attachment/detachment device 19 serving as a counterweight device includes a weight raising/lowering unit 35, and the base plate 33 on which the counterweight 11 is mounted. The weight raising/lowering units 35 are laterally symmetrically disposed pair by pair. The counterweight 11 is formed by stacking weight members 11A, 11B, 11C, 11D, 11E and 11F one on another. The respective weight members 11A to 11F and the base plate 33 are integrally fastened to each other by a link, and are symmetrically arranged on both sides on the base plate 33 (FIGS. 2A to 2C). The respective weight members 11A to 11F are formed in a substantially L-shape in a top view. A pair of right and left counterweights 11 is disposed at a predetermined interval, and a pair of the right and left weight raising/lowering units 35 is disposed in a space between a pair of the counterweights 11.

The weight raising/lowering unit 35 is attached to the base plate 33. A pair of connection plates 37 is respectively and laterally symmetrically erected on an upper surface of the base plate 33. The two connection plates 37 have the same outer shape, and are respectively arranged parallel to a plane orthogonal to a forward-rearward direction. A pair of opening portions 34 (FIGS. 7A and 7B) having a rectangular shape in a top view is formed in the base plate 33. One connection plate 37 is fixed to one edge portion of the opening portion 34, and the other connection plate 37 is fixed to the other edge portion of the opening portion 34.

As illustrated in FIG. 4, the weight raising/lowering unit 35 includes a hydraulic cylinder 39 which stretches and shrinks a cylinder rod 39A in an upward/downward direction, a pair of connection plates 37, and a pair of support brackets 41 integrated with the connection plates 37 by means of welding. The support bracket 41 includes a pair of right and left plates. A pair of the right and left plates is arranged apart from each other at a predetermined interval. The hydraulic cylinder 39 is disposed between a pair of the plates, and the hydraulic cylinder 39 is supported between the plates.

A fixing pin 45 for fixing a rear end portion 17A of the turning frame 17 (to be described later) is removably disposed by a pin insertion/removal mechanism 46. Furthermore, a guide groove 52 which guides a second pin 61 disposed on a free end side (lower portion) of the detachable frame 53 (to be described later) is formed in the support bracket 41. The guide groove 52 is open upward, and has a function to guide the second pin 61 from the upper opening portion, and to position the second pin 61 in a lower bottom portion. As illustrated in FIG. 3, the weight raising/lowering unit 35 includes a pair of symmetrical raising/lowering mechanisms having a configuration illustrated in FIG. 4. Therefore, the same reference numerals will be given to the same configuration elements, and both of these will be described without any particular distinction. In FIG. 3, for example, as the weight raising/lowering unit 35 on the front side, the front side is illustrated, and as the weight raising/lowering unit 35 on the rear side, the rear side is illustrated. The free end side of the detachable frame 53 means an end portion on an installation side of the second pin 61 of the detachable frame 53 which is the free end side when the first pin 57 serves as a pivoting spindle.

As described above, the hydraulic cylinder 39 is supported on the baseplate 33 by the support brackets 41 integrated with the connection plates 37. In this case, the cylinder tube 39B of the hydraulic cylinder 39 is disposed between the support brackets 41 integrated with a pair of the right and left connection plates 37, and is supported by the support brackets 41. The cylinder rod 39A of the hydraulic cylinder 39 is stretched upward with respect to the cylinder tube 39B, and is shrunk downward. Pressure oil is supplied to the cylinder tube 39B from the turning frame 17 via a hydraulic hose, and the cylinder rod 39A performs stretching and shrinking operations.

On an upper portion side of the cylinder tube 39B of the hydraulic cylinder 39, trunnions 47 protrude in a direction perpendicular the support brackets 41. A substantially triangular attachment plate 49 is attached to an upper end portion of the support brackets 41 via an attachment pin 51. An attachment hole is disposed in the center of the attachment plate 49. The trunnion 47 of the cylinder tube 39B is inserted into the attachment hole so that the hydraulic cylinder 39 is connected to the support brackets 41 so as to be pivotable in the forward-rearward direction.

The first pin 57 for enabling pivotable pin-coupling to a rod end coupling portion 55 of the detachable frame 53 is attached to the cylinder top 39C in a distal end of the cylinder rod 39A. As illustrated in the perspective view of the detachable frame 53 in FIGS. 5A and 5B, the first pin 57 is disposed so as to penetrate a through-hole 60 disposed in an upper portion of right and left plate member 59 of the detachable frame 53, thereby causing a retaining pin 58 to prevent the first pin 57 from being separated from the detachable frame 53. The first pin 57 functions as a pivoting spindle for the cylinder rod 39A of the detachable frame 53, and the detachable frame 53 is pivotable around the first pin 57. A pivoting direction of the detachable frame 53 is parallel to an oscillating direction of the trunnion 47.

Figure 5B:
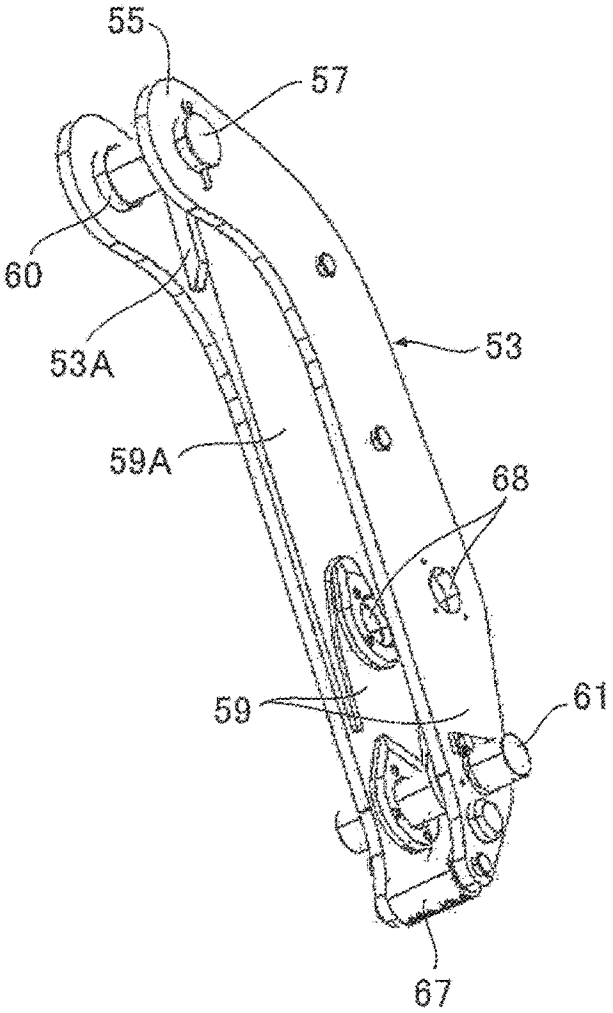
FIGS. 5A and 5B are perspective views of a detachable frame illustrated in FIG. 4.
Figure 5A:
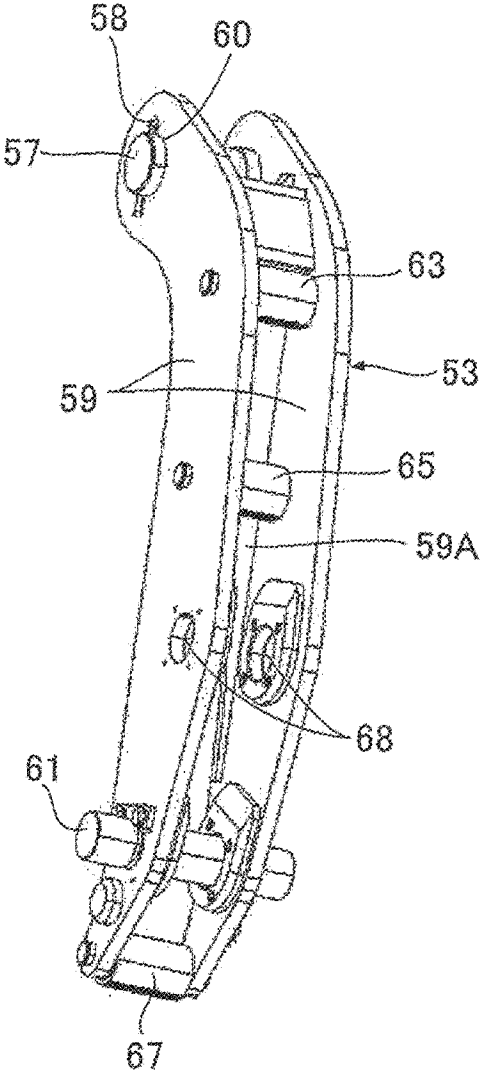

As illustrated in FIGS. 5A and 5B, the detachable frame 53 is configured so that a pair of the right and left plate members 59 having the same shape is integrated with each other in such a way that the first pin 57 functioning as an upper end side spindle is coupled to the second pin 61 on the lower end side so as to be parallel to each other across a member 59A. First, second, and third guide rollers 63, 65, and 67 are disposed in order from above between a pair of the plate members 59. The third guide roller 67 is disposed in a lower end portion, the second guide roller 65 is disposed in a central portion, the first guide roller 63 is disposed in a substantially central portion between the first pin 57 and the second guide roller 65, and a pin insertion hole 68 is disposed between the second guide roller 65 and the second pin 61. FIG. 5A is a perspective view when the detachable frame 53 is viewed from the right front side in FIG. 4, and FIG. 5B is a perspective view when viewed from the left rear side.

As can be understood from FIGS. 4, 5A, and 5B, the detachable frame 53 is formed in a substantially crescent shape, based on an arrangement of the first to third guide rollers 63, 65, and 67, the first and second pins 57 and 61, and the pin insertion hole 68. The shape of the detachable frame 53 is determined based on the arrangement of the same as the arrangement of the first to third guide rollers 63, 65, and 67, the first and second pins 57 and 61, and the pin insertion hole 68, and an end surface shape of the rear end portion 17A of the turning frame 17 (to be described later). Therefore, the shape of the detachable frame 53 is designed in accordance with mechanical capability of the crawler crane 100 and a shape of the turning frame 17. Therefore, as a matter of course, the shape of the detachable frame 53 may be different from the shape according to the present embodiment.

As illustrated in FIG. 4, the hydraulic cylinder 39 and the detachable frame 53 connected to the cylinder top 39C are supported by the support bracket 41 via the integrated trunnion 47 so as to be capable of oscillating in a direction parallel to the support bracket 41. Therefore, the trunnion 47 functions as an oscillating spindle of the hydraulic cylinder 39 with respect to the support bracket 41. A center of gravity of the hydraulic cylinder 39 and the detachable frame 53 which are integrated with each other is located on the right side in the drawing with respect to a vertical line passing through the trunnion 47, which is on the front side based on the turning frame 17. In other words, a momentum is generated in the clockwise direction in the hydraulic cylinder 39 and the detachable frame 53 which are integrated with each other. This state represents a state of a front side center of gravity. In this state, if the cylinder rod 39A of the hydraulic cylinder 39 is stretched, the momentum is further increased. In some cases, the detachable frame 53 may be shaken, and the third guide roller 67 disposed in the lower end of the detachable frame 53 may collide with the cylinder Rod 39A.

In order to prevent this collision, according to the present embodiment, a rail 71 is installed on a side where the cylinder tube 39B of the hydraulic cylinder 39 is attached to the turning frame 17. An installation length of the rail 71 is set to a length which enables the detachable frame 53 to maintain a state of being in contact with the rail 71 even in a case where the cylinder rod 39A is stretched to the maximum. Specifically, although the third guide roller 67 moves while rolling on the rail 71, the length does not cause the third guide roller 67 to be deviated from the rail 71.

Figures 6A, 6B, 6C, 6D, 6E:
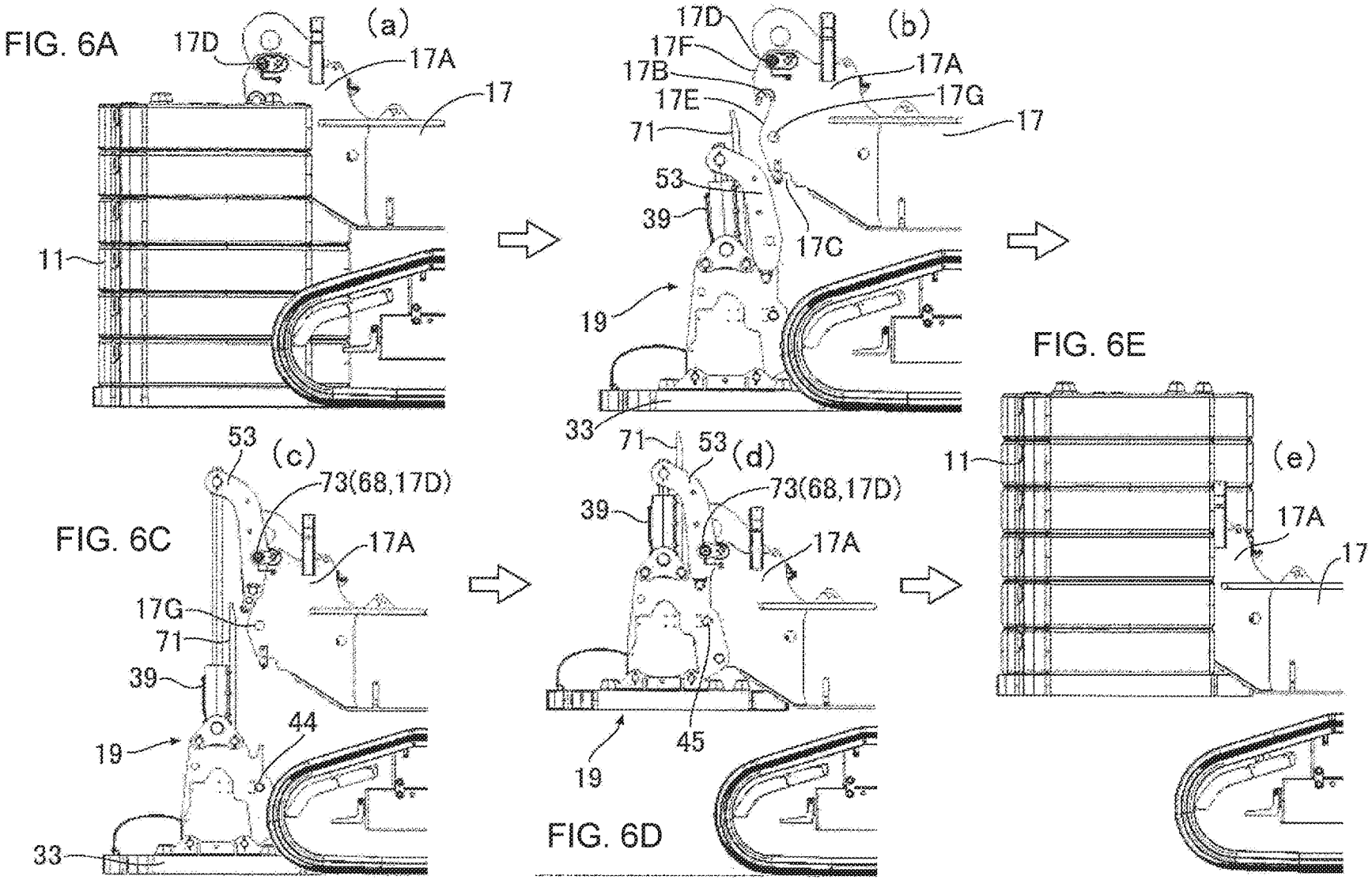
FIGS. 6A to 6E are operation diagrams illustrating a self-mounting operation of the counterweight attachment/detachment device illustrated in FIG. 3.

FIGS. 6A to 6E are operation diagrams illustrating a self-mounting operation of the counterweight attachment/detachment device 19. In FIG. 6B, a portion appearing on the upper right is the rear end portion 17A of the turning frame 17 of the crawler crane 100. In the rear end portion 17A, a first guide groove 17B is formed in the upper portion, a second guide groove 17C is formed in the lower portion, and a pin insertion hole 17D is formed between the rear end portion 17A and the first guide groove 17B below an upper end 17H of a second rolling contact surface 17F (to be described later) which is above the first guide groove 17B. Also, a portion facing the detachable frame 53 between the first and second guide grooves 17B and 17C serves as a first rolling contact surface 17E with which the first and second guide rollers 63 and 65 of the detachable frame 53 come into contact and on which both of these roll. Furthermore, a portion extending from an outer edge of the first guide groove 17B to the uppermost portion of the rear end portion 17A serves as the second rolling contact surface 17F with which the first and second guide rollers 63 and 65 of the detachable frame 53 come into contact and on which both of these roll. The rear end portion 17A of the turning frame 17 is configured in this way.

In a case where the counterweight 11 is attached to the rear end portion 17A by the counterweight attachment/detachment device 19, as illustrated in FIG. 6A, the counterweight attachment/detachment device 19 and the rear end portion 17A of the turning frame 17 are first aligned with each other. When the alignment is performed, the crawler crane 100 is moved rearward, and the rear end portion 17A of the turning frame 17 is located at a position facing the detachable frame 53. FIG. 6B is a diagram illustrating a relationship between the rear end portion 17A and the counterweight attachment/detachment device 19 when the alignment is performed, and the counterweight 11 is omitted in the drawing. In FIGS. 6C and 6D, the counterweight 11 is also omitted in the drawing.

If a positional relationship is completely adjusted between the rear end portion 17A and the counterweight attachment/detachment device 19 in FIG. 6B, as illustrated in FIG. 6C, the cylinder rod 39A of the hydraulic cylinder 39 is stretched, and the detachable frame 53 is pin-coupled to the rear end portion 17A of the turning frame 17. The pin-coupling is performed by aligning the pin insertion hole 68 of the detachable frame 53 with the pin insertion hole 17D of the rear end portion 17A and inserting the coupling pin 73 from the pin insertion hole 68. This pin-coupling couples the detachable frame 53 and the rear end portion 17A of the turning frame 17 to each other, and the detachable frame 53 is attached to the turning frame 17 side.

Thereafter, as illustrated in FIG. 6D, the cylinder rod 39A of the hydraulic cylinder 39 is shrunk, and the base plate 33 and the counterweight 11 fixed thereto are raised. If both of these are raised to a predetermined position, the fixing pin 45 is inserted from a fixing pin insertion hole 44 of the support bracket 41 into a fixing pin insertion hole 17G of the rear end portion 17A by using a push-pull cable 16, and the counterweight 11 is fixed to the rear end portion 17A of the turning frame 17 by using the fixing pin 45 (FIG. 6E).

Figure 7B:
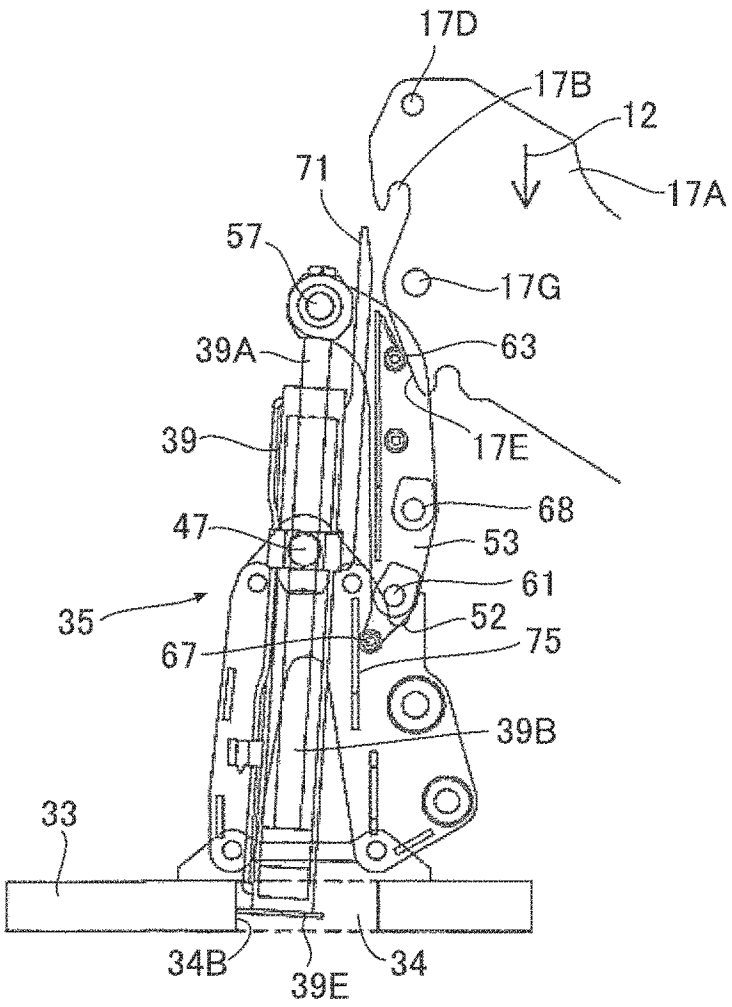
FIGS. 7A and 7B are operation diagrams illustrating a first stage of an operation for attaching and detaching the detachable frame to and from a rear end portion.
Figure 7A:
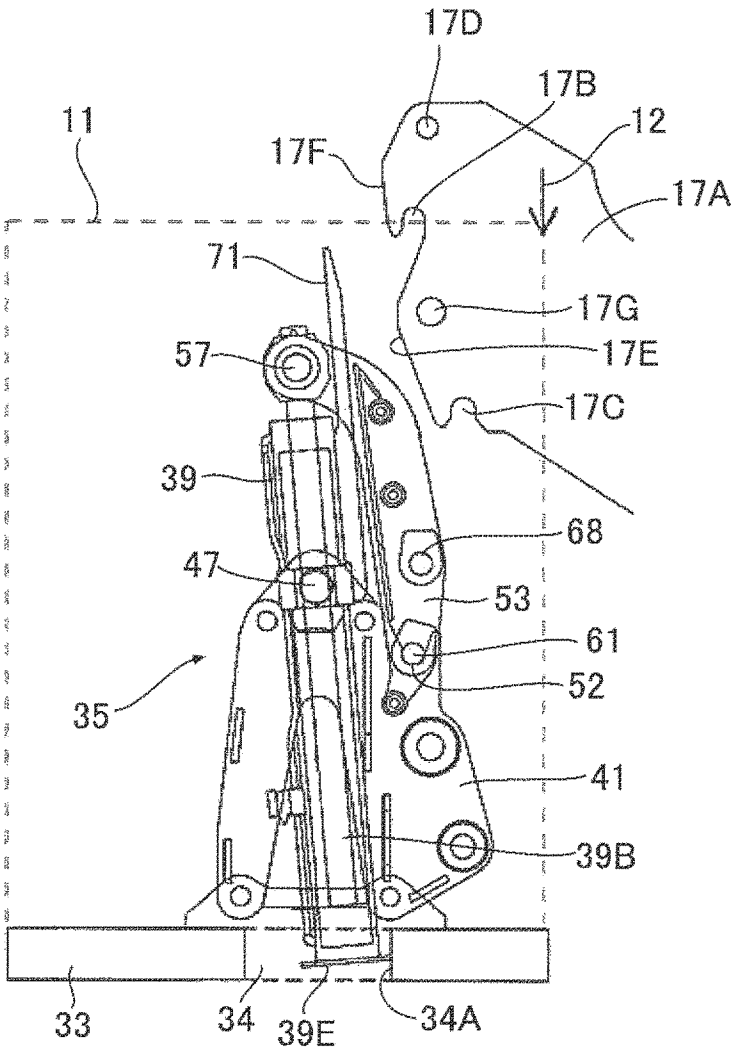

FIGS. 7A to 10B are diagrams for describing operations for attaching and detaching the detachable frame 53 to and from the rear end portion 17A. FIGS. 7A and 7B illustrate an initial stage of the attaching and detaching operation. As illustrated in FIG. 7A, in the initial state, the weight raising/lowering unit 35 is in a state where the cylinder rod 39A of the hydraulic cylinder 39 is most shrunk. In this case, the detachable frame 53 is in a state where the second pin 61 disposed in the lower portion enters the lower bottom portion of the guide groove 52. A flange 39E in the lower end of the cylinder tube 39B of the hydraulic cylinder 39 is in contact with an inner wall 34A on the right side of the opening portion 34 disposed in the base plate 33 in the drawing. Therefore, the flange 39E is stopped by being inclined at an angle defined by a center position of the trunnion 47 and a position where the flange 39E is in contact with the inner wall 34A of the opening portion 34. In the present embodiment, this inclination represents inclination oriented rearward as large as approximately 5° from the vertical line passing through the trunnion 47. In this state, the rear end portion 17A of the turning frame 17 is separated from the detachable frame 53.

In the present specification, the rear side refers to a direction or a position in which the first pin 57 on the distal end portion side of the cylinder rod 39A moves away from or away from the turning frame 17 with respect to the vertical line passing through the trunnion 47. In FIG. 7A, a distal end of an arrow 12 indicates a foremost portion and an uppermost portion of the counterweight 11 on the turning frame 17 side when the counterweight 11 is installed. An arrow 12 in FIGS. 8A to 10B indicates the same, and illustration of the counterweight 11 is omitted.

As illustrated in FIG. 7B, if the cylinder rod 39A of the hydraulic cylinder 39 is stretched, the second pin 61 disengages from the guide groove 52, the weight raising/lowering unit 35 is rotated around the trunnion 47 in the clockwise direction in the drawing, and serves as the front side center of gravity. In this case, the amount of rotation of the hydraulic cylinder 39 is restricted by the flange 39E coming into contact with the inner wall 34B on the left side in the drawing opposite to FIG. 7A of the opening portion 34 of the base plate 33. The amount of rotation of the detachable frame 53 is restricted by the third guide roller 67 coming into contact with a stopper 75 disposed in the support bracket 41. In the present embodiment, for example, due to the rotation in the clockwise direction, the detachable frame 53 is inclined forward, for example, as large as approximately 3.5° from the vertical line. The inclination illustrated in FIG. 7B indicates that the detachable frame 53 is inclined most forward. The front side means direction or a position where the first pin 57 on the distal end portion side of the cylinder rod 39A is closer to the turning frame 17 with respect to the vertical line passing through the trunnion 47.

Figure 8B:
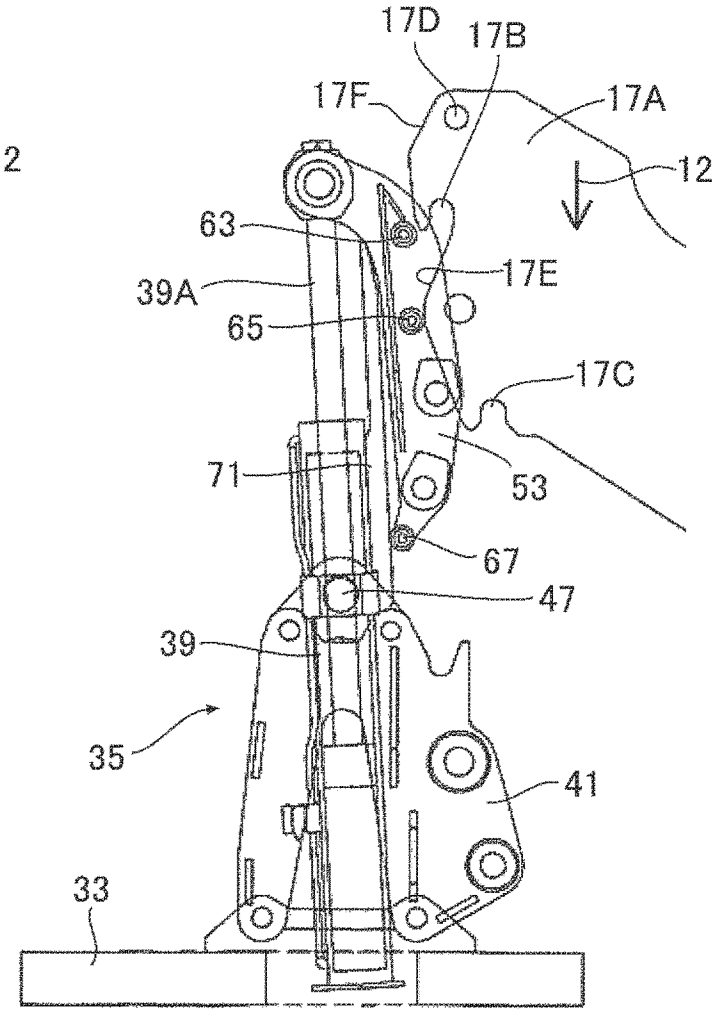
FIGS. 8A and 8B are operation diagrams illustrating that a state illustrated in FIG. 7B is changed to a state where a cylinder rod of a hydraulic cylinder is further stretched.
Figure 8A:
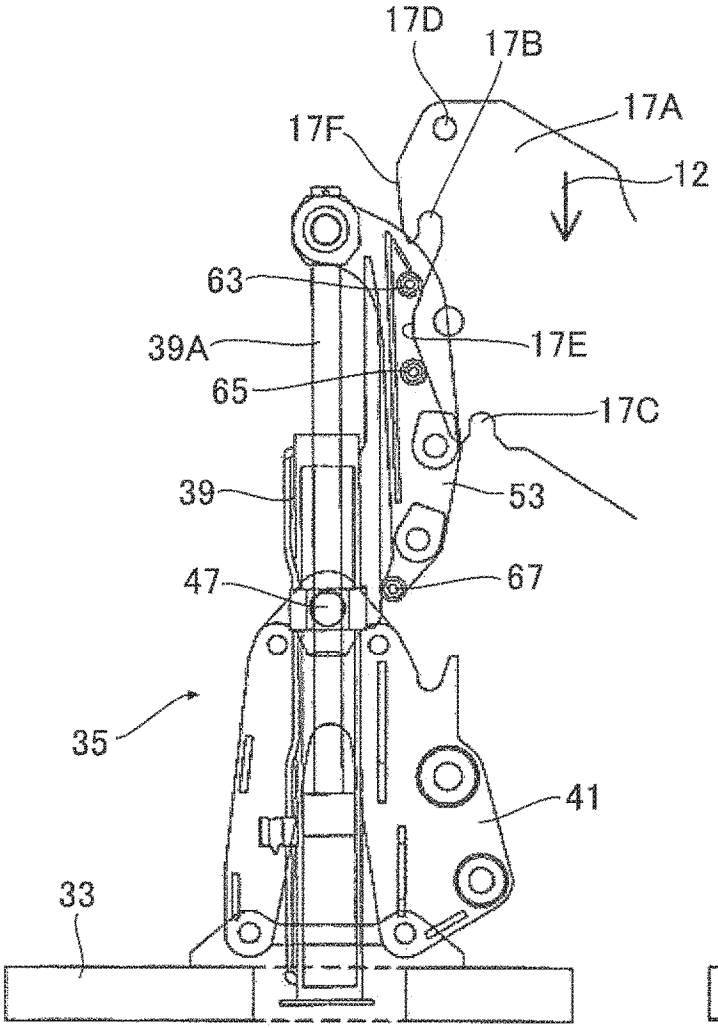
Figure 9B:
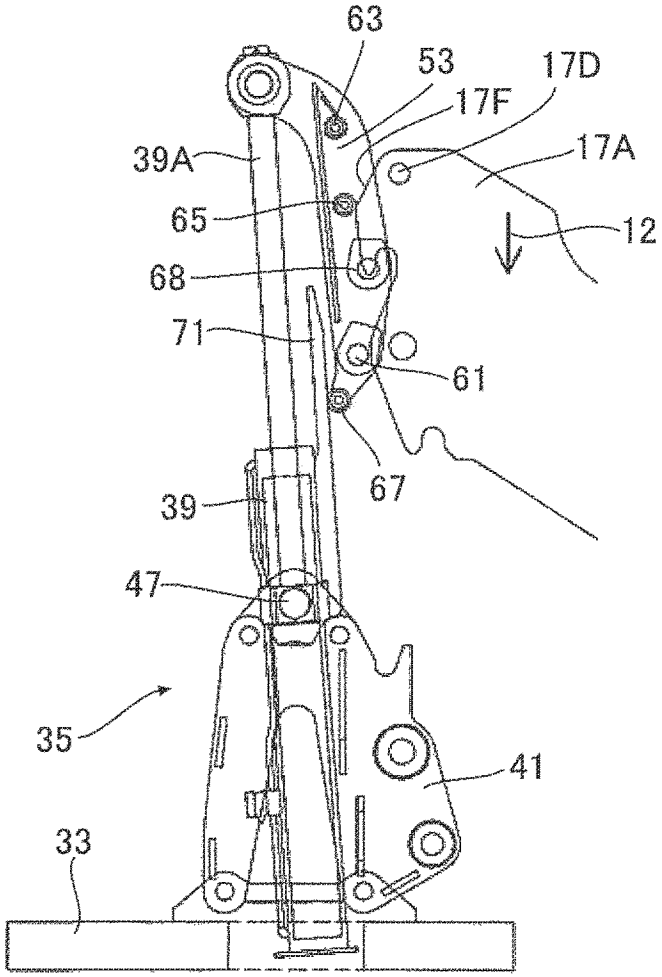
FIGS. 9A and 9B are operation diagrams illustrating that a state illustrated in FIG. 8B is changed to a state where the cylinder rod of the hydraulic cylinder is further stretched.
Figure 9A:
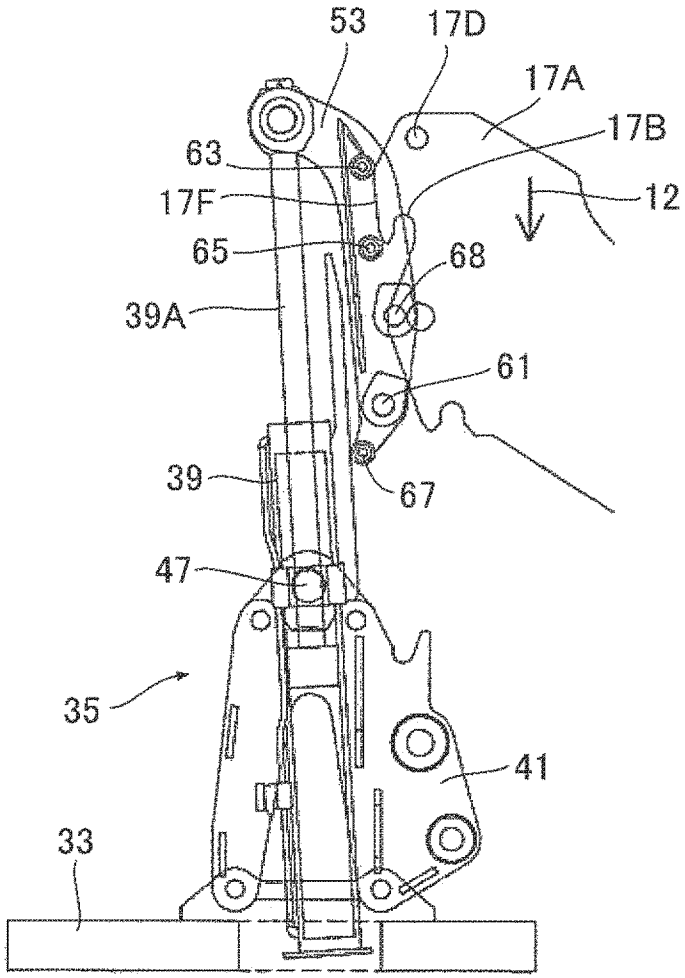

FIGS. 8A and 8B illustrate that a state illustrated in FIG. 7B is changed to a state where the cylinder rod 39A of the hydraulic cylinder 39 is further stretched. FIGS. 9A and 9B illustrate that a state illustrated in FIG. 8B is changed to a state where the cylinder rod 39A of the hydraulic cylinder 39 is further stretched.

If the cylinder rod 39A is further stretched, the first and second guide rollers 63 and 65 in turn come into contact with the first rolling contact surface 17E of the rear end portion 17A of the turning frame 17. Then, as the first and second guide rollers 63 and 65 roll along the first and second rolling contact surfaces 17E and 17F, the detachable frame 53 is pushed up, and the inclination of the hydraulic cylinder 39 is changed. Along with the stretched cylinder rod 39A, the third guide roller 67 comes into contact with the lower end portion of the rail 71, and rolls on the rail 71, thereby restricting a position of the lower end of the detachable frame 53.

The rear end portion 17A of the turning frame 17 is provided a first guide groove 17B for accommodating the second pin 61 when moving upward. However, the first and second guide rollers 63 and 65 alternately support the detachable frame 53 while rolling on the first and second rolling contact surfaces 17E and 17F, thereby preventing the first and second the guide rollers 63 and 65 from being caught on the first guide groove 17B (FIGS. 8B, 9A, and 9B). FIG. 8A illustrates a state when the second guide roller 65 comes into contact with the first rolling contact surface 17E. FIG. 8B illustrates a state where the first guide roller 63 onto the second rolling contact surface 17F across the first guide groove 17B, in other words, a state where the first guide roller 63 crosses over a valley.

If the cylinder rod 39A is further stretched, a state illustrated in FIG. 9A is obtained. FIG. 9A illustrates a state where the second the guide roller 65 crosses the first guide groove 17B. In other words, this state indicates a state where the second guide roller 65 crosses the valley. In this state, the first and second guide rollers 63 and 65 move to and roll on the second rolling contact surface 17F, and the third guide roller 67 rolls on the rail 71. FIG. 9B illustrates a state where the hydraulic cylinder 39 is inclined most rearward in a stretching process. In this case, the second guide roller 65 rolls across the most protruding (protruding toward the rear end side) portion of the second rolling contact surface 17F. In other words, this state indicates a state where the second guide roller 65 crosses a mountain. FIG. 9B illustrates a state where the hydraulic cylinder 39 is inclined most rearward. In FIG. 9B, the center of gravity of the hydraulic cylinder 39 and the detachable frame 53 holds an angle at which the hydraulic cylinder 39 and the detachable frame 53 are not inclined rearward across the vertical line passing through the trunnion 47.

Figure 10B:
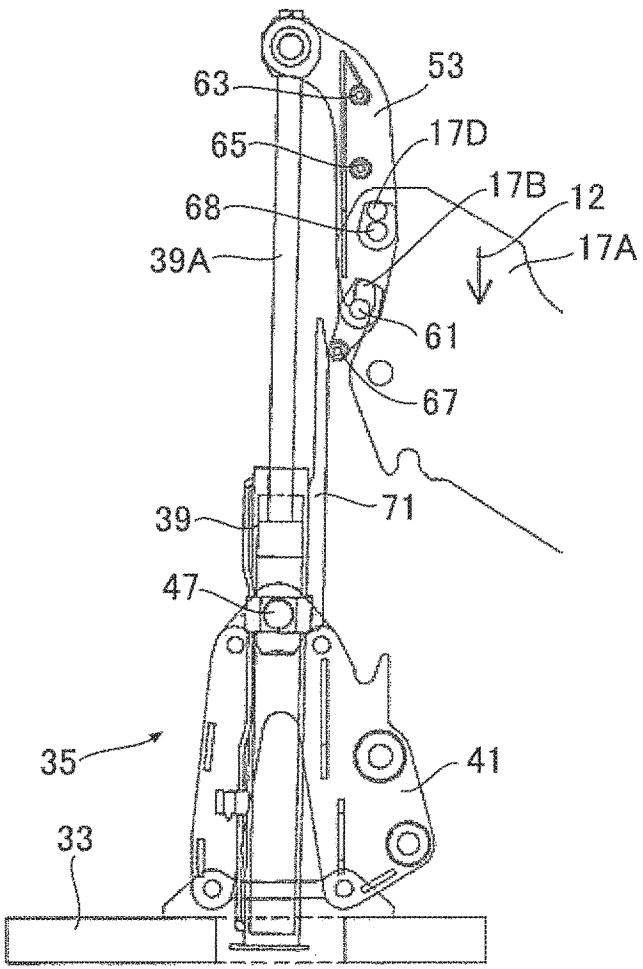
FIGS. 10A and 10B are operation diagrams illustrating that a state illustrated in FIG. 9B is changed to a state where the cylinder rod of the hydraulic cylinder is further stretched.
Figure 10A:
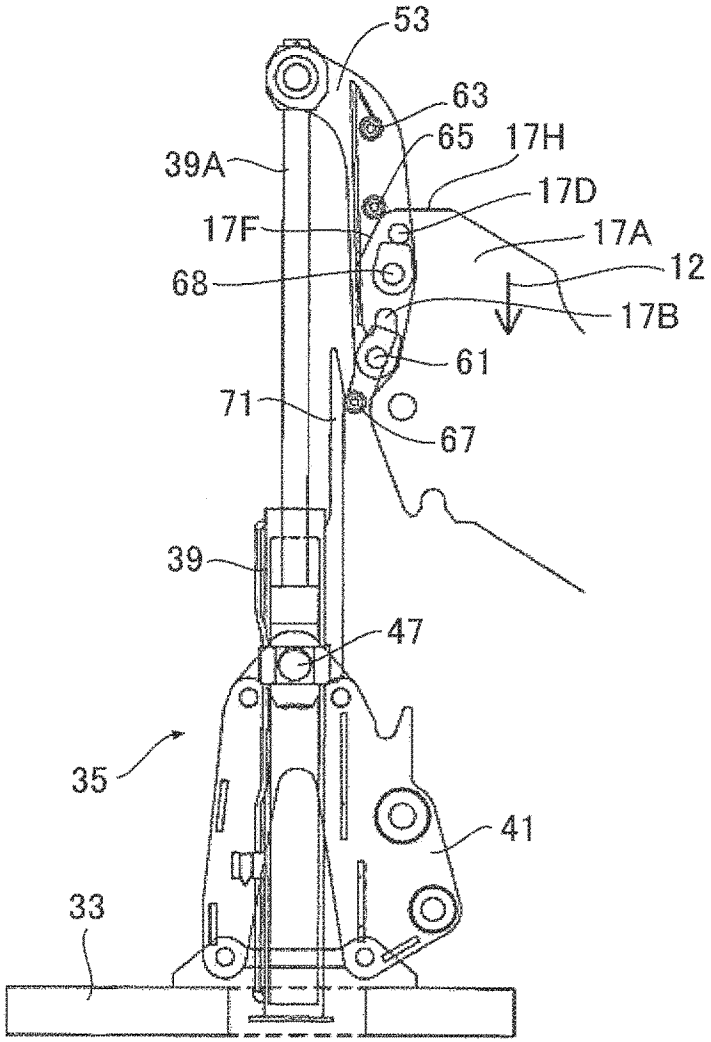

FIGS. 10A and 10B illustrate that a state illustrated in FIG. 9B is changed to a state where the cylinder rod 39A of the hydraulic cylinder 39 is further stretched. If the cylinder rod 39A of the hydraulic cylinder 39 is further stretched in the state illustrated in FIG. 9B, the first and second guide rollers 63 and 65 cross the second rolling contact surface 17F, and reach the upper end 17H of the rear end portion 17A of the turning frame 17. At this timing, the second pin 61 reaches an entrance of the first guide groove 17B (FIG. 10A).

If the cylinder rod 39A is further stretched, the second pin 61 is guided by the first guide groove 17B, and moves inside the first guide groove 17B. In this case, the second pin 61 is fitted into a deepest portion of the first guide groove 17B in a form of being raised by the detachable frame 53 (FIG. 10B). Finally, the detachable frame 53 is rotated around the second pin 61 serving as a fulcrum, and is accommodated in the attachment position. In this way, in FIG. 10A, the second pin 61 is guided to the first guide groove 17B. In FIG. 10B, an operation is performed so that the rear end portion 17A of the turning frame 17 is caught on the second pin 61.

If the detachable frame 53 is accommodated at the attachment position, the pin insertion hole 68 overlaps the pin insertion hole 17D formed in the rear end portion 17A of the turning frame 17. In this state, the pin insertion hole 68 and the pin insertion hole 17D coincide with each other. Accordingly, the coupling pin 73 is inserted from the pin insertion hole 68, and the detachable frame 53 is coupled and fixed to the rear end portion 17A of the turning frame 17. In a course leading to this coupling, the present embodiment is configured to avoid a possibility that the first and second guide grooves 17B and 17C may engage with the connection structure elements other than the first and second pins 57 and 61 which engage with the first and second guide grooves 17B and 17C.

This indicates a state illustrated in FIG. 6C, and this state is changed to a state illustrated in FIGS. 6D and 6E. In this manner, the counterweight 11 is attached to the rear end portion 17A of the turning frame 17. When the counterweight 11 is detached, the attachment operations described so far may be performed in reverse.

Figure 11:
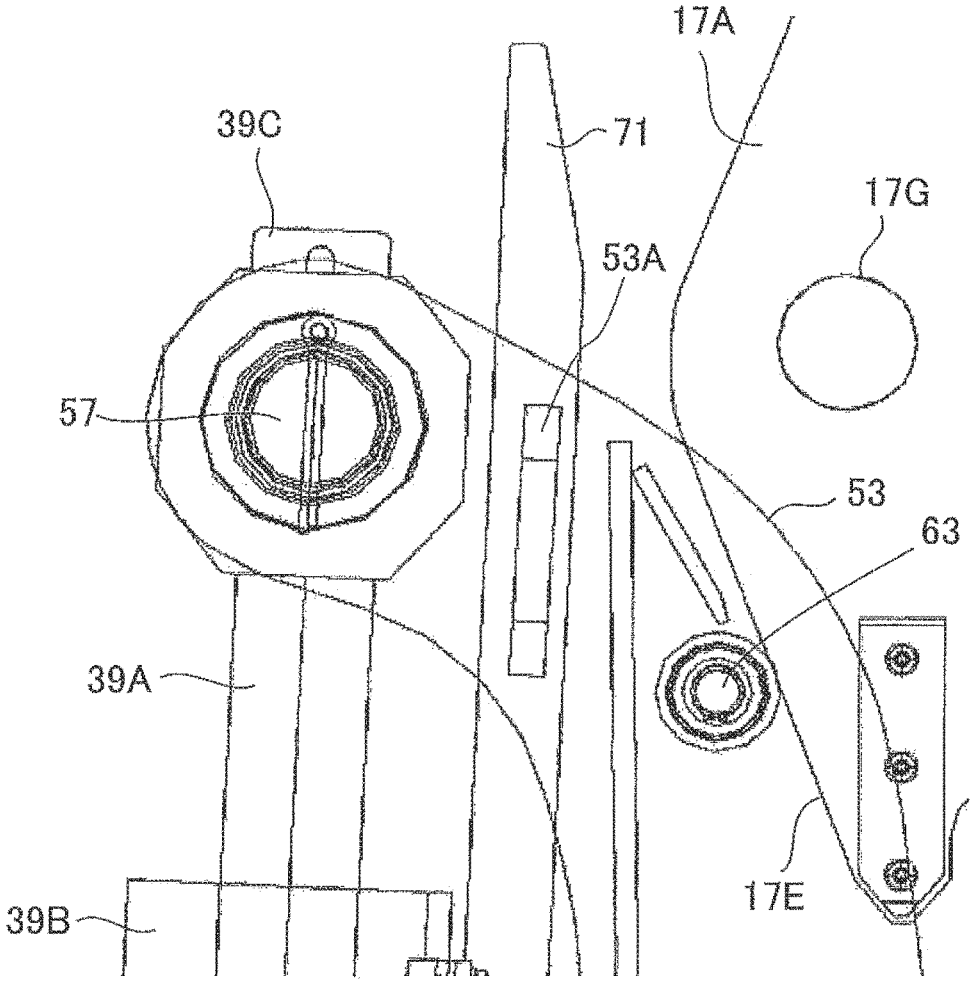
FIG. 11 is a view illustrating a configuration for preventing the cylinder rod from being rotated when the cylinder rod of the hydraulic cylinder is shrunk.

FIG. 11 is a view illustrating a configuration for preventing the cylinder rod 39A from being rotated around a cylinder rod axis when the cylinder rod 39A of the hydraulic cylinder 39 is shrunk. In a state where a rod length of the cylinder rod 39A is short and the detachable frame 53 does not pinch the rear end portion 17A of the turning frame 17, the rail 71 is used as a detent for the cylinder rod 39A. That is, the weight of the detachable frame 53 is added to the distal end of the cylinder rod 39A. Accordingly, in a state where the cylinder rod 39A is slightly stretched from FIG. 7A, the detachable frame 53 tries to be rotated around the cylinder rod axis. A restriction member 53A pinches and restricts the rail 71, thereby preventing the detachable frame 53 from being rotated around the cylinder rod axis. In this case, if there is no rail 71, an orientation of the detachable frame 53 is changed due to the rotation, thereby causing a possibility that that the detachable frame 53 may be deviated from the turning frame 17.

The present embodiment is characterized in that the counterweight 11 is attachable to and detachable from the counterweight attachment/detachment device 19 in a state where the counterweight attachment/detachment device 19 serves as the front side center of gravity. In this manner, it is possible to considerably reduce the weight of the counterweight attachment/detachment device 19. The counterweight attachment/detachment device disclosed in the related art has the following problem when the counterweight is attached to the turning frame while the counterweight attachment/detachment device serves as the front side center of gravity. The guide pin held by the turning frame or the detachable frame may interfere with the detachable frame facing the guide pin in a stage earlier than a time point for guiding.

In the present embodiment, in order to prevent this interference, the first and second guide rollers 63 and 65 are used so as to enable the detachable frame 53 to be lifted along the line of the first and second rolling contact surfaces 17E and 17F on the end surface of the rear end portion 17A of the turning frame 17. The second pin 61 serving as the guide pin is installed on the detachable frame 53 side. Accordingly, the weight of the turning frame 17 can be further reduced. In this case, if the guide is disposed on the turning frame 17 side, there is a possibility that the guide roller may be caught. However, in order to solve the problem, two guide rollers (first and second guide rollers 63 and 65) are installed.

As described above, according to the present embodiment, the following advantageous effects are obtained. In the following description, each configuration element in the claims and each unit according to the present embodiment are in a corresponding relationship. In a case where the terms of both of these are different from each other, the former is indicated using parenthesis, or the corresponding reference numerals are given to both of these so as to clarify the correspondence relationship between both of these.

(1) The present embodiment adopts a configuration as follows. The counterweight attachment/detachment device (counterweight device) 19 has the base plate (mounting table) 33 on which the counterweight 11 to be attached to the turning frame (machine body frame) 17 of the crawler crane (construction machine) 1 is mounted, the hydraulic cylinder 39 that is supported by the rear end portion 17A of the turning frame 17, and that raises and lowers the counterweight 11 mounted on the base plate 33 together with the base plate 33, and the detachable frame (connection structure) 53 that connects the base plate 33 and the cylinder rod 39A of the hydraulic cylinder 39 to each other. The counterweight attachment/detachment device (counterweight device) 19 includes the first pin (pivoting spindle) 57 that supports the detachable frame 53 so as to be pivotable with respect to the cylinder rod 39A, the guide coupling portion that guides the free end (second pin 61 installation) side of the detachable frame 53 to the rear end portion 17A side of the turning frame 17 in response to the stretching/shrinking state of the cylinder rod 39A, and that is coupled to the turning frame 17 below the upper end 17H of the rear end portion 17A, and the rail (guide member) 71 that guides the free end side of the turning frame 17 to the hydraulic cylinder 39 side in the direction parallel to the stretching/shrinking direction of the cylinder rod 39A.

According to this configuration, the guide coupling portion is disposed integrally with the rear end portion 17A of the turning frame 17, and is coupled the detachable frame 53 below the upper end 17H of the detachable frame 53. Accordingly, it is not necessary to detach the bracket used in the related art. In addition, it is not necessary that the connection frame in the related art serves as the rear side center of gravity. Accordingly, the weight for setting the connection frame as the rear side center of gravity is not required, and the weight of the detachable frame 53 serving as the connection frame is reduced. Therefore, the counterweight 11 is attachable and detachable in a state where the detachable frame 53 serves as the front side center of gravity.

(2) In the present embodiment, the guide coupling portion is configured to include the first guide groove (guide groove) 17B that performs positioning for coupling to the detachable frame 53, the first and second rolling contact surfaces (guide surfaces) 17E and 17F that includes the first guide groove 17B, and that guides the detachable frame 53 by inhibiting the connection structure element other than the second pin (engagement member) 61 engaging with the first guide groove 17B from engaging with the first guide groove 17B, and the pin insertion hole (coupling member mounting portion) 17D that mounts the coupling member which couples the detachable frame 53 and the turning frame 17 to each other, in a state where the second pin 61 is positioned by engaging with the first guide groove 17B.

According to this construction, except that the second pin 61 is fitted into the first guide groove 17B, the connection structure element is inhibited from being fitted into the first guide groove 17B. Therefore, it is possible to prevent the detachable frame 53 and the turning frame 17 from engaging with each other due to the connection structure element other than the second pin 61 which is fitted into the first guide groove 17B. Accordingly, the counterweight attachment/detachment device 19 can be prevented from being erroneously operated.

(3) In the present embodiment, a configuration is adopted as follows. The coupling member is the coupling pin 73, and the coupling member mounting portion is the pin insertion hole 17D which is aligned with the pin insertion hole 68 formed in the detachable frame 53 when the positioning is performed, and which is formed in the rear end portion (guide coupling portion) 17A of the turning frame 17.

According to this configuration, the pin insertion hole 68 formed in the detachable frame 53 and the pin insertion hole 17D formed below the upper end 17H of the rear end portion 17A of the turning frame 17 are aligned with each other when the positioning is performed. Accordingly, the coupling pin 73 is inserted into the pin insertion hole 17D from the pin insertion hole 68, and is held inside the pin insertion hole 68 and the pin insertion hole 17D. In this simple manner, the detachable frame 53 and the rear end portion 17A of the turning frame 17 can be coupled to each other.

(4) In the present embodiment, a configuration is adopted as follows. The connection structure element guided to the first and second rolling contact surfaces 17E and 17F includes the two first and second guide roller 63 and 65 disposed at the preset interval. One guide roller 63 (65) is inhibited from being fitted into the first guide groove 17B by the other guide roller 65 (63) rolling on the first and/or second rolling contact surfaces 17E and/or 17F.

According to this configuration, only the second pin 61 is fitted into the first guide groove 17B by merely setting the end surface shape of the rear end portion 17A of the turning frame 17 and the position of the first and second guide rollers 63 and 65. In this manner, the pin insertion hole 68 formed in the detachable frame 53 and the pin insertion hole 17D formed in the rear end portion 17A of the turning frame 17 can be aligned with each other.

(5) In the present embodiment, a configuration is adopted as follows. The hydraulic cylinder 39 is supported so as to be rotatable in the axial direction with respect to the trunnion (oscillating spindle) 47, and the center of gravity position of the weight raising/lowering unit 35 including the detachable frame 53 and the hydraulic cylinder 39 serves as the front side center of gravity located on the turning frame 17 side from the vertical line passing through the trunnion 47.

According to this configuration, it is not necessary that the center of gravity position of the weight raising/lowering unit 35 serves as the rear side center of gravity farther away from the turning frame 17 side than the vertical line passing through the trunnion 47. Accordingly, an extra weight for setting the rear side center of gravity is not required. Therefore, since cost reduction can be achieved and the device can be more easily handled, operability can be improved.

(6) According to the crawler crane (construction machine) 100 including the counterweight device in the present embodiment, the advantageous effects described in (1) to (5) can be obtained.

It should be understood that the invention is not limited to the above-described embodiment, but may be modified into various forms on the basis of the spirit of the invention. Additionally, the modifications are included in the scope of the invention.

What is claimed is:

1. A counterweight device comprising:

a mounting table on which a counterweight is mountable;

a hydraulic cylinder that comprises a cylinder rod and is configured to raise and lower the mounting table;

a connection structure that is configured to connect a rear end portion of a machine body frame of a construction machine with the cylinder rod, the connection structure comprises a coupling member; and a pivoting spindle that pivotably supports the connection structure with respect to the cylinder rod;

the rear end portion comprises a guide coupling portion that is configured to guide a free end side of the connection structure to the rear end portion in response to a stretching/shrinking state of the cylinder rod, the guide coupling portion comprises a mounting member, the coupling member is configured to be coupled with the mounting member; and the counterweight device further comprises a guide member that is arranged between the hydraulic cylinder or the cylinder rod and the free end side of the connection structure.

2. The counterweight device according to claim 1, wherein the guide coupling portion includes:

a guide groove that is configured to engage an engagement member of the connection structure, the guide coupling portion comprises a guide surface that includes the guide groove, and that has a shape formed to guide the connection structure by avoiding an element of the connection structure other than the engagement member from engaging with the guide groove, and the mounting member is configured to mount the coupling member when the engagement member is engaged with the guide groove.

3. The counterweight device according to claim 2, wherein the coupling member comprises a coupling pin and a first pin insertion hole, and the mounting member comprises a second pin insertion hole formed in the guide coupling portion, the coupling pin is configured to be inserted, while coinciding the second pin insertion hole with the first pin insertion hole, to the first and the second pin insertion holes when the engagement member engages with the guide groove.

4. The counterweight device according to claim 2, wherein the element includes first and second guide rollers arranged at a preset interval, and the first guide roller is inhibited from being fitted to the guide groove by the second guide roller while the second guide roller is rolling on the guide surface.

5. The counterweight device according to claim 4, wherein the connection structure further includes a third guide roller, and the free end side of the connection structure is restricted from pivoting around the pivoting spindle by the third guide roller by bringing the third guide roller into contact with the guide member.

6. The counterweight device according to claim 1, further comprising:

an oscillating spindle that pivotably supports the hydraulic cylinder, wherein a center of gravity of the hydraulic cylinder and the connection structure is located on a side of the machine body frame with respect to a vertical line passing through the oscillating spindle.

7. A construction machine comprising:

the counterweight device according to claim 1 wherein the mounting table is attached to the rear end portion of the machine body frame.

8. The construction machine according to claim 7, wherein the hydraulic cylinder is attached to the machine body frame of the construction machine.

9. The construction machine according to claim 7, wherein the hydraulic cylinder is attachable to the rear end portion of the machine body frame of the construction machine.

10. The counterweight device according to claim 1, wherein the guide member is configured to have a length capable of being in contact with the free end side of the connection structure when the hydraulic cylinder is stretched to the maximum.

11. The counterweight device according to claim 1, wherein the guide member is configured to guide the free end side of the connection structure in a direction parallel to a stretching/shrinking direction of the cylinder rod.

12. The counterweight device according to claim 1, further comprising:

an oscillating spindle that pivotably supports the hydraulic cylinder;

support brackets that support the oscillating spindle; and the hydraulic cylinder is capable of oscillating between the support brackets, wherein one of the support bracket comprises a restriction member that is configured to restrict oscillation of the hydraulic cylinder.

13. The counterweight device according to claim 1, wherein the connection structure includes:

a first guide roller that is configured to be in contact with the guide member; and an engagement member configured to engage the guide coupling portion; and the first guide roller is located closer to the free end side of the connection structure than the engagement member.

14. The counterweight device according to claim 1, wherein the guide coupling portion includes a guide groove that performs positioning for coupling to the connection structure, the guide member restricts the free end side of the connection structure from pivoting around the pivoting spindle before the guide groove performs positioning for coupling to the connection structure.

15. The counterweight device according to claim 14, wherein the guide member is configured to restrict the free end side of the connection structure from pivoting around the pivoting spindle before the guide coupling portion comes into contact with the connection structure.

16. The counterweight device according to claim 15, further comprising, an oscillating spindle that supports the hydraulic cylinder so as to oscillate with respect to the mounting table, wherein the guide member includes a guide rail which is integrated with the hydraulic cylinder and pivots around the oscillating spindle with respect to the mounting table, and a stopper which does not pivot around the oscillating spindle with respect to the mounting table, the guide rail restricts the free end side of the connection structure from pivoting around the oscillating spindle before the guide groove performs positioning for coupling to the connection structure, and the stopper restricts the free end side of the connection structure from pivoting around the oscillating spindle before the guide coupling portion comes into contact with the connection structure.

17. A counterweight device comprising:

a mounting table on which a counterweight is mountable;

a hydraulic cylinder that comprises a cylinder rod and is configured to raise and lower the mounting table;

a connection structure that comprises a coupling member and an engagement member;

a pivoting spindle that pivotably supports one end of the connection structure at an end of the cylinder rod; and a guide member that is arranged between a free end of the connection structure and the hydraulic cylinder or between the free end and the cylinder rod, the guide member is configured to guide the free end; wherein the free end is configured to be guided by a guide coupling portion of a construction machine in response to a stretching/shrinking state of the cylinder rod;

the coupling member is configured to be coupled with a mounting member of the guide coupling portion; and the engagement member is engageable with a guide groove of the guide coupling portion.

18. The counterweight device according to claim 17, the guide coupling portion comprises a guide surface that includes the guide groove, and that has a shape formed to guide the connection structure by avoiding an element of the connection structure other than the engagement member from engaging with the guide groove, and the mounting member is configured to mount the coupling member when the engagement member is engaged with the guide groove.

19. The counterweight device according to claim 18, wherein the coupling member comprises a coupling pin and a first pin insertion hole, and the mounting member comprises a second pin insertion hole formed in the guide coupling portion, the coupling pin is configured to be inserted, while coinciding the second pin insertion hole with the first pin insertion hole, to the first and the second pin insertion holes when the engagement member engages with the guide groove.

20. The counterweight device according to claim 18, wherein the element includes first and second guide rollers arranged at a preset interval, and the first guide roller is configured to be inhibited from being fitted to the guide groove by the second guide roller while the second guide roller is configured to be rolling on the guide surface.

* * * * *